US007481905B2

(12) United States Patent
Parén et al.

(10) Patent No.: US 7,481,905 B2
(45) Date of Patent: Jan. 27, 2009

(54) PROCESS FOR MANUFACTURING BOARD

(75) Inventors: Aarto Parén, Vaasa (FI); Jukka Jäkärä, Vaasa (FI); Ari Juppo, Vaasa (FI); Reetta Strengell, Vaasa (FI)

(73) Assignee: Kemira Oyj, Helsinki (FI)

( * ) Notice: Subject to any disclaimer, the term of this patent is extended or adjusted under 35 U.S.C. 154(b) by 304 days.

(21) Appl. No.: 10/322,730

(22) Filed: Dec. 19, 2002

(65) Prior Publication Data

US 2003/0150574 A1 Aug. 14, 2003

(30) Foreign Application Priority Data

Dec. 19, 2001 (FI) ..... 20012508

(51) Int. Cl.
*D21C 9/00* (2006.01)
*D21H 21/00* (2006.01)
*D21H 21/16* (2006.01)
*D21H 17/14* (2006.01)

(52) U.S. Cl. ..... 162/78; 162/76; 162/142; 162/150; 162/158; 162/179

(58) Field of Classification Search ..... 162/75–76, 162/78, 158, 180, 164.1, 181.1, 181.3, 179, 162/9, 70, 141–142, 150
See application file for complete search history.

(56) References Cited

U.S. PATENT DOCUMENTS

| | | | | |
|---|---|---|---|---|
| 4,222,819 | A * | 9/1980 | Fossum et al. | 162/76 |
| 4,410,619 | A * | 10/1983 | Kubbota et al. | 430/234 |
| 4,454,005 | A * | 6/1984 | Stofko et al. | 162/12 |
| 4,559,103 | A * | 12/1985 | Nomura et al. | 162/160 |
| 4,927,496 | A * | 5/1990 | Walkden | 162/136 |
| 5,139,614 | A * | 8/1992 | dePierne et al. | 162/135 |
| 5,552,018 | A * | 9/1996 | Devenyns | 162/76 |
| 6,695,950 | B1 * | 2/2004 | Cimecioglu et al. | 162/157.6 |
| 2003/0150574 | A1 * | 8/2003 | Paren et al. | 162/158 |
| 2003/0152574 | A1 * | 8/2003 | Logan et al. | 424/146.1 |
| 2004/0140074 | A1 * | 7/2004 | Tokarz et al. | 162/181.8 |
| 2004/0149166 | A1 * | 8/2004 | Nurminen et al. | 162/158 |
| 2005/0224202 | A1 * | 10/2005 | Sundberg et al. | 162/135 |
| 2005/0257909 | A1 * | 11/2005 | Lindgren et al. | 162/181.2 |

FOREIGN PATENT DOCUMENTS

| | | | |
|---|---|---|---|
| EP | 0 074 544 | A1 | 3/1983 |
| EP | 0 292 975 | B1 | 12/1992 |
| FI | 104339 | B | 12/1999 |
| GB | 2 158 474 | A | 11/1985 |
| JP | 57-21591 | A | 2/1982 |
| WO | WO 99/32710 | A1 | 1/1999 |
| WO | WO 00/77301 | A1 | 12/2002 |

OTHER PUBLICATIONS

PTo Certified Translation of Finnis Patnet Document No. 104339, of Dec. 25, 1999.*
Tappi Feb. 1965, vol. 48, No. 2 (Paper Bleaching—A New Process, W.H. Rapson et al), pp. 65-72.
Kemi-Kemi, No . 3 (1995), Jyri Maunuksela, Mikrobien torjunta peretikkahapolla, s. 242-244.
Appita Journal, vol. 51, No. 4, s. 306-310 (C. Leduc et al).
Pulp and Paper Magazine of Canada, Mar. 1968, s. 123-131, "Effects of Chelating and De-Ashing Treatments on the Peracetic Acid Bleaching of Groundwood".
Pulp and Paper Magazine of Canada, May 1968, s. 51-60, M. Wayman, C.B. Anderson et al, "Bleaching Characteristics of Heartwood and Sapwood Groundwood of Jack Pine and Western Hemlock".
Steven A. Walkden; Tappi Journal; Apr. 1991; pp. 103-104.
A. Isogai et al.; Journal of Pulp and Paper Science; vol. 23, No. 5; May 1997; pp. J215-J219.
D. Lachenal et al.; Ecole Francaise De Papeterie and Centre Technique Du Papier; France Sep. 8-11, 1996; pp. 203-211.

* cited by examiner

*Primary Examiner*—José A Fortuna
(74) *Attorney, Agent, or Firm*—Birch, Stewart, Kolasch & Birch, LLP

(57) ABSTRACT

The invention relates to a process for manufacturing liquid packaging board, in which process a board pulp is treated with a percarboxylic acid by adding to the pulp percarboxylic acid in an amount of 0.5-5 kg/ton of dry pulp, indicated as a 100 percent percarboxylic acid, whereafter, or simultaneously with the percarboxylic acid treatment, sizing is carried out with a combination of a resin size and a neutral size, which is followed by board forming. The manufactured board has good resistance to liquid penetration.

14 Claims, No Drawings

PROCESS FOR MANUFACTURING BOARD

This nonprovisional application claims priority under 35 U.S.C. § 119(a) on Patent Application No. 2001-2508 filed in FINLAND on Dec.19, 2001, which is herein incorporated by reference.

The invention relates to a process for manufacturing liquid packaging board and to a method by which the properties of liquid packaging boards can be improved, in particular their resistance to the penetration of liquid.

The use of peracetic acid for the bleaching of chemical pulps is known, for example, from Japanese patent publication JP 57-21591. Bleaching processes of this type aim at removing lignin from the pulp, and in this case the question is not of any intention to modify the fiber surface for the sizing process, as is the case in the process according to the present invention described below.

From patent application FI 974575 there is known a process for bleaching chemical pulps, the process comprising an after-bleaching step wherein peracetic acid is used in the presence of an alkaline-earth metal compound. The purpose of this after-bleaching is specifically to improve the brightness of the pulp.

Patent publication FI 104339 discloses a process wherein a bleached stock (chemical pulp) is modified with peracetic acid before neutral sizing. The method relates to a process for manufacturing fine paper, wherein the bleached chemical pulp is introduced, after a treatment with peracetic acid, into a papermaking process wherein a neutral size is used. In the process disclosed in the publication, the pulp being treated must be bleached (brightness >85% ISO and kappa number <4). FI-04339 thus relates to a process wherein, before the peracetic acid treatment, lignin is removed from the pulp to be treated. In the process according to the invention described hereinafter, the pulp to be treated contains a significant amount of lignin, and the sizing is carried out with a sizing composition containing a resin size.

Publication Tappi 2/1965, Vol. 48, No. 2 (Paper Bleaching—A new Process, W. H. Rapson et al.) discloses a process for bleaching paper with, for example, peracetic acid. This process aims at increasing the brightness of the paper product. In the process disclosed, peracetic acid is used in considerably large amounts, for example, on page 68, second paragraph, the dose is approx. 1.2-2.5% (i.e. 12-5 kg/ton of pulp). Such a dose may dissolve a considerable amount of lignin etc. out of the pulp, whereby the papermaking process may be severely disturbed.

The use of peracids as biocides is known, for example, from publication Kemia-Kemi, No. 3 (1995), Jyri Maunuksela, Mikrobien torjunta peretikkahapolla (Microbe Prevention with Peracetic Acid), pp. 242-244. Such a method aims only at destroying microbial populations in the paper machine. It is self-evident that peracetic acid, which is known as an effective biocide, inhibits microbial activity in the water circulation if it is present in a sufficient amount. The method disclosed in the publication uses so-called equilibrium peracetic acid, which contains considerable amounts of free acetic acid and hydrogen peroxide. The acetic acid and hydrogen peroxide present in the peracid may interfere with the papermaking process.

For use in the bleaching of mechanical pulps there have also been disclosed activators that together with hydrogen peroxide produce peracids. Such a method is disclosed, for example, in publication Appita Journal Vol. 51, No. 4, pp. 306-310 (C. Leduc et al.). The method aims at increasing pulp brightness. The method also has the disadvantage of considerably large doses of chemicals.

There have also been presented bleaching methods based on peracid, aiming at improving the brightness of the pulp as compared with conventional bleaching methods. Such a method is disclosed, for example, in publication Pulp and Paper Magazine of Canada, Convention Issue, 1972, pp. 123-131, and in issue 3/1968, pp. 51-60, of the same magazine. The peracid doses used in these methods are very large, typically 1% (i.e. 10 kg/ton of pulp), and thus they dissolve a considerable amount of lignin from the surfaces of fibers. Furthermore, these methods aim at increasing the brightness of the pulp, i.e. bleaching.

Furthermore, from publication WO-00/77301 A1 there is known a method for improving the opacity of mechanical pulp by adding a percarboxylic acid to a bleaching solution that contains hydrogen peroxide or by treating with a percarboxylic acid a mechanical pulp that has been bleached with hydrogen peroxide or dithionite. This process produces paper having a high opacity.

The object of the present invention is to provide a process for manufacturing liquid packaging board, whereby in particular the resistance of the board to the penetration of liquid is improved. In the manufacture of liquid packaging boards, the important parameters include so-called lactic acid REP and peroxide REP, which describe the penetration of lactic acid and peroxide solutions into the board. In terms of the usability of liquid packaging board it is essential that liquids cannot penetrate into the board. It has now been observed unexpectedly that by treating the board pulp with a small dose of a percarboxylic acid and by carrying out thereafter sizing with a mixture of a resin size and a neutral size, a surprising improvement can be achieved in this respect. The essential point of the invention is that the surface of the fibers in the board pulp is first modified by a percarboxylic acid treatment, whereafter the sizing is carried out with the said sizing composition.

In the peracid treatments known from the above-mentioned publications, the object has in the main been to increase brightness or to improve opacity or to inhibit microbial growth by using the peracid as a biocide. The invention specifically relates to a procedure wherein, in connection with the manufacture of liquid packaging board, a percarboxylic acid treatment is used for modifying the surface of fibers in a lignin-containing board pulp for the purpose of sizing.

In accordance with the invention there is thus provided a process for the manufacture of liquid packaging board, wherein a board pulp is treated with a percarboxylic acid by adding to the pulp a percarboxylic acid in an amount of 0.5-5 kg/ton of dry pulp, indicated as a 100 percent percarboxylic acid, whereafter, or simultaneously with the percarboxylic acid treatment, sizing is carried out with a combination of a resin size and a neutral size, which is followed by board forming.

According to the invention, the sizing with a combination of a resin size and a neutral size is preferably carried out after the percarboxylic acid treatment.

In the sizing it is possible to use a mixture of a resin size and a neutral size, or they can be added to the pulp separately.

The board pulp used may be a mechanical pulp such as groundwood (SGW, PGW), refiner mechanical pulp (TMP) or chemi-mechanical pulp (CTMP) or an unbleached chemical pulp, or mixtures thereof. Together with the pulps mentioned above it is possible to use as a mixture also chemical pulps, such as kraft pulp. The species of wood used for the manufacture of the pulp is not of significance in terms of the functioning of the invention.

A preferred percarboxylic acid dose is 1-3 kg/ton of pulp. The percarboxylic acid used may be any moderately water-soluble percarboxylic acid. Performic acid, peracetic acid and perpropionic acid have been found to be preferable, and peroxide-free distillates prepared from their equilibrium solutions have been found to be especially preferable. The process by which the percarboxylic acid is prepared does not affect the functioning of the invention. Percarboxylic acid solutions purified either by distillation or in some other manner or equilibrium solutions of percarboxylic acids can be used as the percarboxylic acid. Various mixtures of percarboxylic acids are also usable. In one variant of the invention it is possible to use a mixture of a percarboxylic acid and an inorganic peracid such as Caro's acid. In another variant of the invention, the peracetic acid can be prepared from hydrogen peroxide and an activator such as TAED (tetra-acetylethylene diamine).

In the process according to the invention, a combination of a resin size and a neutral size is used for sizing. The resin may be a resin or a reinforced resin. The neutral size may be an alkyl ketene dimer (AKD), alkenyl ketene dimer, alkenyl succinic acid anhydride (ASA) or alkyl succinic acid anhydride, preferably AKD. The amounts of size used may vary within the range 1-10 kg/ton of dry pulp and the pH may be within the range 3-11, preferably 4-9, depending on the process. The resin and the neutral size may be added to the pulp mix either separately or as a combination size. The resin/neutral size dose ratio may vary within a wide range, and preferably the ratio is, on the basis of weight, 9:1-1:9. It is also self-evident that the point at which the size is added or the order in which the other chemicals are added or the other run parameters of the paper machine do not as such affect the functioning of the invention. What is essential in the invention is that after the percarboxylic acid treatment the pulp mix is directed to the board manufacturing process, wherein a neutral size, preferably AKD, and a resin size are used for the sizing.

According to the invention the procedure may also be that a portion of the board pulp is treated with a percarboxylic acid, and this treated pulp is subsequently combined with a board pulp that has not been treated with a percarboxylic acid, and thereafter the pulp mix is sized. In this case, for example, a mechanical pulp may be treated with a percarboxylic acid and be combined with a chemical pulp that has not been treated with a percarboxylic acid.

In one preferred embodiment of the invention the percarboxylic acid treatment and/or the sizing step is carried out in the presence of an agent that stabilizes the percarboxylic acid. Such a stabilizing agent may be various complexing agents, such as DTPA or EDTA, or phosphonates, such as DTPMPA, N-bis-[(1,2-dicarboxyl-ethoxy)-ethyl]amine, N-tris-[(1,2-dicarboxyl-ethoxy)-ethyl]amine. It is also possible to use as the stabilizing agent salts of alkaline-earth metals, such as calcium compounds, for example calcium acetate or calcium carbonate, or magnesium compounds, for example magnesium sulfate, or aluminum compounds, such as alum. The complexing agents may also be used in the form of their alkaline-earth metal salts. An especially preferred embodiment of the method according to the invention is to add the complexing agents at the same time as the sizing mixture. The invention also relates to a procedure wherein an aluminum-containing compound, such as alum, is added to the pulp either in connection with the percarboxylic acid treatment or thereafter.

The consistency of the board pulp at the stage at which the percarboxylic acid is added may be 0.1-40%, and the temperature may be 20-100° C. As was pointed out above, the pH of the stock may be, depending on the process, 3-11, preferably 4-8. The suitable reaction time is 1-300 minutes, depending on the process. The delay between the percarboxylic acid treatment and the sizing does not substantially affect the functioning of the invention; the percarboxylic acid treatment can be carried out simultaneously with the sizing.

According to the invention there is additionally provided a process by which the resistance of liquid packaging board to the penetration of liquid is improved, and in which, in connection with the board manufacture, the board pulp is treated with a percarboxylic acid by adding to the pulp a percarboxylic acid in an amount of 0.5-5 kg/ton of dry pulp, indicated as a 100 percent percarboxylic acid, whereafter, or simultaneously with the percarboxylic acid treatment, sizing is carried out with a combination of a resin size and a neutral size.

In methods according to the invention the purpose of the percarboxylic acid is not to bleach the pulp; the purpose is to modify the surface of the fibers to a suitable state before the sizing. Thereafter the pulp mix is sized with a suitable sizing composition that contains a resin size and a neutral size, preferably AKD. In addition to an improved sizing result the use of a percarboxylic acid reduces microbial activity in the paper machine and reduces the odor of the board.

Owing to the small dose of percarboxylic acid in the method according to the invention, the percarboxylic acid does not dissolve lignin, etc., out of the pulp, in which case it also does not interfere with the board manufacturing process. It is especially advantageous to use percarboxylic acid solutions that have been purified so that they contain only the percarboxylic acid concerned and water. In this case the percarboxylic acid addition does not have a significant effect on the pH of the stock, and there will be no excess COD in the process. The invention differs from known methods based on peracids specifically in that its object is not to increase brightness but to make the sizing more effective so that the penetration of liquids into the board will be less.

The process according to the invention is not a bleaching process, and the chemicals used in the actual bleaching of the pulp do not have any effect on the functioning of the process. A mechanical pulp may be bleached with dithionite, peroxide, dithionite and peroxide, or it may be completely unbleached. Also, the chelating or other auxiliary agents used in the preparation of the pulp have no effect on the functioning of the invention.

The invention is described below in greater detail with the help of examples. In the present description the percentages are percentages by weight, unless otherwise specified.

EXAMPLE 1

A CTMP pulp was treated with perpropionic acid before sizing. The perpropionic acid used had been prepared by distillating an equilibrium solution of perpropionic acid; the solution did not contain significant amounts of free peroxide or propionic acid. A mixture of a CTMP pulp and an unbleached softwood kraft pulp was sized with a resin-AKD system (Ref.) and with a combination size (Comb.). Lactic acid REP and peroxide REP were determined from the sheets; they describe the penetration of lactic acid and peroxide solutions into the sheet. The results are shown in Table 1.

TABLE 1

| Pulp | Ref. 5/3 LA | Ref. 5/3 $H_2O_2$ | Comb. 5/3 LA | Comb. 5/3 $H_2O_2$ |
|---|---|---|---|---|
| Untreated | 0.37 | 1.21 | 0.75 | 1.17 |
| PPA-treated | 0.37 | 1.01 | 0.81 | 1.05 |

Pulp mix: CTMP 40%, unbleached softwood kraft pulp 60%

PPA treatment/CTMP: 60 min, 60° C., consistency 5%, dPPA 3.3 kg/ton of pulp, pH 7.2

Sizing at a consistency of 0.3%, grammage of sheets 130 g/m$^2$

Ref. 5/3: Alum 6.5 kg/ton of pulp+resin size 5 kg/ton of pulp+Hydrores 360 M 3 kg/ton of pulp (AKD)

Comb. 5/3 (combination size): resin size 5 kg/ton of pulp+AKD 3 kg/ton of pulp

LA=lactic acid REP, 1 h, 1% lactic acid solution, room temperature $H_2O_2$=peroxide REP, 10 min, 35%, 70° C.

From the results it can be observed that the PPA treatment clearly improved peroxide REP.

EXAMPLE 2

A CTMP pulp was treated with peracetic acid before sizing. The peracetic acid had been prepared by distillation of an equilibrium solution of peracetic acid; the solution did not contain significant amounts of free peroxide or acetic acid. A mixture of the CTMP pulp and an unbleached SA pulp was sized both with the resin+AKD system (Ref.) and with combination sizes (Comb.). Lactic acid REP and peroxide REP were determined from the sized sheets. The results are shown in Table 2.

TABLE 2

| Pulp | Ref. 4.2/2.5 LA | Ref. 4.2/2.5 $H_2O_2$ | Comb. 5/3 (5 + 3) LA | Comb. 5/3 (5 + 3) $H_2O_2$ | Comb. 1/3 (1.4 + 4.1) LA | Comb. 1/3 (1.4 + 4.1) $H_2O_2$ |
|---|---|---|---|---|---|---|
| Untreated (1) | 0.34 | 1.23 | | | | |
| PAA-treated (1) | 0.32 | 0.99 | | | | |
| Untreated (2) | | | 0.75 | 1.17 | | |
| PAA-treated (2) | | | 0.70 | 1.09 | | |
| Untreated (3) | | | | | 0.69 | 3.15 |
| PAA-treated (3) | | | | | 0.69 | 2.26 |

LA=lactic acid REP $H_2O_2$=peroxide REP (1): pulp mix CTMP 50% and unbleached SA pulp 50%

PAA treatment/CTMP: 60 min, 60° C., consistency 5%, dPAA 3 kg/ton, pH 7

Sizing at a consistency of 0.3%, grammage of the sheets 130 g/m$^2$

Ref. 4.2/2.5: alum 5.5 kg/ton of pulp+resin size 4.2 kg/ton of pulp+AKD 2.5 kg/ton of pulp (2): pulp mix CTMP 40% and unbleached SA 60%

PAA treatment/CTMP: 60 min, 60° C., consistency 5%, dPAA 3 kg/ton, pH 7.2

Sizing at a consistency of 0.3%, grammage of the sheets 130 g/m$^2$

Comb. 5/3 (combination size):resin size 5 kg/ton of pulp+AKD 3 kg/ton of pulp (3): pulp mix:CTMP 40%, unbleached SA 30%, reject 30%

PAA treatment/CTMP: 5 min, 80° C., consistency 3%, dPAA 3 kg/ton

Sizing at a consistency of 0.3%, grammage of the sheets 130 g/m$^2$

Comb. 1/3 (combination size): resin 1.4 kg/ton+AKD 4.1 kg/ton

It can be seen from the results that especially the peroxide REP was improved by the PAA treatment.

EXAMPLE 3

An unbleached softwood kraft pulp was treated with peracetic acid before sizing. The pulp was sized with a resin+AKD system. Lactic acid REP and peroxide REP were determined from the sheets. The results are shown in Table 3.

TABLE 3

| Pulp | Ref. 4/0.8 LA | Ref. 4/0.8 $H_2O_2$ |
|---|---|---|
| Untreated | 0.47 | 0.66 |
| PAA-treated | 0.58 | 0.45 |

Pulp: unbleached softwood kraft pulp

PAA treatment: 10 min, 60° C., consistency 5%, dPAA 3 kg/ton, pH 7

Sizing at a consistency of 0.3%, grammage of the sheets 130 g/m$^2$

Ref. 4/0.8: alum 4.8 kg/ton+resin 4 kg/ton+AKD 0.8 kg/ton

It can be seen from the results that with softwood kraft pulp peroxide REP improved in the PAA treatment.

The invention claimed is:

1. An improved process for treatment of liquid packaging board with lactic acid or peroxide solutions, the process comprising manufacture of the board, in which a board pulp is subjected to a substantially non-delignifying treatment with a percarboxylic acid by adding to the pulp having a consistency of 0.1 to 40% and a pH of 3 to 11 percarboxylic acid in an amount of 0.5-5 kg/ton of dry pulp, indicated as a 100 percent percarboxylic acid, the addition substantially not effecting the pH of the pulp, whereafter, or simultaneously with the percarboxylic acid treatment, sizing of the pulp having the pH of 3 to 11 is carried out with a combination of a rosin size and a neutral size, which is followed by board forming from the pulp in a paper machine, wherein the percarboxylic acid comprises peracetic acid, prepropionic acid, or a mixture thereof, and the board pulp consists essentially of a pulp containing lignin, the pulp containing lignin being selected from a group consisting of groundwood mechanical pulp, refiner mechanical pulp, chemi-mechanical pulp, unbleached chemical pulp, and a mixture thereof, and subjecting the board to a lactic acid or peroxide solution, whereby the board has improved resistance to raw edge penetration (REP) of lactic acid or peroxide.

2. The process according to claim 1, characterized in that the sizing is carried out after the percarboxylic acid treatment by using a mixture of a rosin size and a neutral size.

3. The process according to claim 2 or 1, characterized in that the neutral size is an alkyl ketene dimer, alkenyl ketene dimer, alkenyl succinic acid anhydride or alkyl succinic acid anhydride.

4. The process according to claim 1 or 2, characterized in that the neutral size is an alkyl ketene dimer.

5. The process according to claim 1, characterized in that the percarboxylic acid is added to the board pulp in an amount of 1-3 kg/ton of dry pulp, indicated as a 100 percent percarboxylic acid.

6. The process according to claim 1 characterized in that in connection with the sizing step there is added one or more agents stabilizing the percarboxylic acid.

7. The process according to claim 6, characterized in that the one or more agents stabilizing the percarboxylic acid is a complexing agent or an alkaline-earth metal compound.

8. The process according to claim 1, characterized in that in connection with the sizing step there is added one or more aluminum compounds.

9. The process according to claim 8, characterized in that the one or more aluminum compounds is an alum.

10. The process according to claim 1, characterized in that the percarboxylic acid is distilled peracetic acid.

11. The process according to claim 1, characterized in that the pH at the said sizing step is within the range 4-9.

12. The process according to claim 1, characterized in that the board pulp is treated with a percarboxylic acid by adding to the pulp percarboxylic acid in an amount of 1-3 kg/ton of dry pulp, indicated as a 100 percent percarboxylic acid.

13. The process according to claim 1, wherein the board pulp consists of a pulp containing lignin, the pulp containing lignin being selected from a group consisting of groundwood mechanical pulp, refiner mechanical pulp, a chemi-mechanical pulp, an unbleached chemical pulp, and a mixture thereof.

14. A process of manufacturing a board, comprising:

subjecting a board pulp consisting essentially of a pulp containing lignin selected from the group consisting of groundwood mechanical pulp, refiner mechanical pulp, chemi-mechanical pulp, unbleached chemical pulp, and a mixture thereof to a substantially non-delignifying treatment with percarboxylic acid, which comprises peracetic acid, prepropionic acid or a mixture thereof by adding to the pulp percarboxylic acid in an amount of 0.5-5 kg/ton of dry pulp, indicated as a 100 percent percarboxylic acid, the percarboxylic acid being added to modify the surface of the fibres in the pulp;

thereafter, or simultaneously with the percarboxylic acid treatment, sizing the pulp with the modified fibre surfaces is with a combination of a rosin size and a neutral size;

thereafter, forming a board from the pulp in a paper machine; and subjecting the board to a peroxide solution to produce reduced raw edge penetration (REP) of peroxide.

* * * * *